US006954163B2

(12) United States Patent
Toumazou et al.

(10) Patent No.: US 6,954,163 B2
(45) Date of Patent: Oct. 11, 2005

(54) HYBRID DIGITAL/ANALOG PROCESSING CIRCUIT

(75) Inventors: Christofer Toumazou, Oxford (GB); Alison Burdett, Abingdon (GB)

(73) Assignee: Toumaz Technology Limited, South Oxford (GB)

( * ) Notice: Subject to any disclaimer, the term of this patent is extended or adjusted under 35 U.S.C. 154(b) by 0 days.

(21) Appl. No.: 10/486,210

(22) PCT Filed: Aug. 16, 2002

(86) PCT No.: PCT/GB02/03796

§ 371 (c)(1),
(2), (4) Date: Feb. 17, 2004

(87) PCT Pub. No.: WO03/017180

PCT Pub. Date: Feb. 27, 2003

(65) Prior Publication Data

US 2004/0205097 A1 Oct. 14, 2004

(30) Foreign Application Priority Data

Aug. 17, 2001 (GB) ..... 0120186

(51) Int. Cl.[7] ..... H03M 1/66
(52) U.S. Cl. ..... 341/144; 341/110
(58) Field of Search ..... 341/110, 144, 341/120, 61, 139; 382/278

(56) References Cited

U.S. PATENT DOCUMENTS 4,449,193 A * 5/1984 Tournois ..... 382/278
5,659,312 A * 8/1997 Sunter et al. ..... 341/120
5,661,478 A * 8/1997 Matsushige ..... 341/61
5,909,186 A * 6/1999 Gohringer ..... 341/120
5,946,354 A * 8/1999 Ashley et al. ..... 375/260
6,215,429 B1 * 4/2001 Fischer et al. ..... 341/139

FOREIGN PATENT DOCUMENTS

DE 3505989 A1 9/1985

* cited by examiner

*Primary Examiner*—Jean Bruner-Jeanglaude
(74) *Attorney, Agent, or Firm*—Erik B. Cherdak; Arent Fox PLLC

(57) ABSTRACT

A circuit comprising a digital processor, analogue processing means, a digital to analogue converter for converting digital values output from the digital processor into analogue values which are processed by the analogue processing means, and an analogue to digital converter for converting resulting analogue values into digital values for input to the digital processor, wherein the analogue processing means comprises one or more analogue processors, and the circuit is dynamically reconfigurable under the control of the digital processor, such that analogue values are processed according to a first function by the analogue processing means, and following reconfiguration, analogue values are processed according to a second function by the analogue processing means.

37 Claims, 3 Drawing Sheets

HYBRID DIGITAL/ANALOG PROCESSING CIRCUIT

CROSS-REFERENCE TO RELATED APPLICATION

This application is a National Stage entry of International Application No. PCT/GB02/03796, filed Aug. 16, 2002, the entire specification claims and drawings of which are incorporated herewith by reference.

BACKGROUND OF THE INVENTION

1. Field of the Invention

The present invention relates to a circuit.

2. Discussion of Related Art

The majority of contemporary circuits are digital. Analogue circuits are generally considered to be difficult to build, and to be less stable than digital circuits. Where it is possible to provide a function using an analogue circuit or an equivalent digital circuit, the digital circuit is invariably used. Despite this there remain applications for which analogue circuits are preferred. For example analogue amplifiers are preferred in some applications.

Circuits which perform analogue functions in general suffer from a lack of flexibility.

SUMMARY OF THE INVENTION

It is an object of the present invention to provide a circuit which overcomes or mitigates the above disadvantage.

Digital semiconductor technology has advanced steadily for many years, leading to smaller transistor dimensions and increasing numbers of transistors per chip. The rate of increase of computing power provided by digital processors has doubled every 18 months, a phenomenon known as Moore's law.

There is a continuing demand for increased processing power. However in many applications, particularly portable devices, power consumption is an important limiting factor. In a digital processor, power consumption is a function of the number of transistor gates multiplied by the number of switching cycles per second. As the number of transistors and the number of switching cycles have increased, processor power consumption has become an important issue. Battery lifetime and processing power are increasingly incompatible, with the result that the processing power and/or battery lifetime of many portable devices is severely limited.

There are fundamental performance limits associated with providing large numbers of transistors in a single large-scale digital integrated circuit. These limits are a consequence of the ever-decreasing dimensions of the active and passive elements (including on-chip connections). Problems that arise as the performance limits are approached include the generation of substantial amounts of heat. The heat generated by high power processing chips is already such that heat dissipation is a significant issue. It has been speculated that heat dissipation problems will begin to introduce substantial limitations on the further increase of processing power and performance. Other problems associated with large-scale digital integrated circuits include parasitic capacitance and cross talk.

It is an object of the present invention to provide a circuit that overcomes or substantially mitigates at least one of the above disadvantages.

According to the invention there is provided a circuit comprising a digital processor, analogue processing means, a digital to analogue converter for converting digital values output from the digital processor into analogue values which are processed by the analogue processing means, and an analogue to digital converter for converting resulting analogue values into digital values for input to the digital processor, wherein the analogue processing means comprises one or more analogue processors, and the circuit is dynamically reconfigurable under the control of the digital processor, such that analogue values are processed according to a first function by the analogue processing means, and following reconfiguration, analogue values are processed according to a second function by the analogue processing means.

The invention is advantageous because it provides flexibility, allowing different functions to be applied as required, using the analogue processing means.

Preferably, the digital processor is operative to tune operating parameters of the analogue processing means once the analogue processing means has been reconfigured to process analogue values according to the second function. This is advantageous because it ensures that the second function is applied correctly by the analogue processing means.

The analogue processing means may comprise a plurality of analogue processors arranged to process analogue values according to different functions, a first analogue processor being arranged to process analogue values according to the first function and a second analogue processor being arranged to process analogue values according to the second function, the digital processor being operative to select the analogue processors.

A given analogue processor may be configured to process analogue values according to the first function, and has adjustable operating parameters such that the same analogue processor may be reconfigured to process analogue values according to the second function, by adjusting the operating parameters, the digital processor being operative to select the operating parameters.

Preferably, the circuit is a digital signal processing system, and the first and second functions are computational functions. The term computational function is intended to mean a function that could be performed digitally by a conventional microprocessor. This preferred feature of the invention overcomes disadvantages associated with conventional digital processing. In particular, analogue processing may be used to apply functions which are computationally very expensive using digital processing, thereby providing substantial reductions of power consumption. This provides twin benefits, namely longer battery lifetime and reduced heat generation.

Preferably, the digital processor is a microprocessor. The term microprocessor is intended to mean a processor capable of running an instruction set. The term microprocessor is not intended to imply that the processor includes all of the functionality of a conventional microprocessor. For example, the microprocessor may be a microprocessor core.

Alternatively, the digital processor may be constructed from dedicated logic.

Preferably, the circuit further comprises an analogue signal demultiplexer arranged to select an analogue processor required by the digital processor, the analogue signal demultiplexer being connected between the digital to analogue converter and the analogue processor.

Preferably, the analogue signal demultiplexer includes an input from an analogue processor.

Preferably, the digital processor is operative to select more than one analogue processor in combination in order to provide a combined function.

Preferably, the circuit further comprises a switch arranged to select the combination of the analogue processors.

Preferably, the switch is a cross-point switch.

Preferably, at least one of the analogue processors comprises a plurality of processing channels, and the circuit further comprises a switch arranged to select a required number of channels to provide a function with a required accuracy or speed.

Preferably, the switch is a cross-point switch.

Preferably, the circuit further comprises an analogue signal multiplexer connected between the analogue processing means and the analogue to digital converter.

Preferably, the analogue signal multiplexer is provided with an output which passes to an analogue processor.

Preferably, the analogue signal multiplexer is provided with an input from an analogue processor.

Preferably, the circuit further comprises bias current generation means arranged to provide bias currents which determine operating parameters of the one or more analogue processors.

Preferably, the circuit further comprises bias latches connected to the bias current generation means, the bias latches being arranged to hold digital values which determine the bias currents provided by the bias current generation means.

Preferably, the digital values held by the bias latches are provided by the digital processor.

The digital processor may be arranged to tune operating parameters of one or more analogue processors by adjusting the operating parameters individually, applying a test signal to the one or more analogue processors, monitoring the output of the one or more analogue processors, and iterating until the operation of one or more analogue processors is determined to be satisfactory.

Alternatively, the digital processor may be arranged to tune operating parameters of one or more analogue processors by repeatedly adjusting a plurality of operating parameters of the one or more analogue processors in combination and monitoring the response to a test signal of the one or more analogue processors, in order to obtain statistical information relating to operation of the one or more analogue processors, and then selecting an optimal set of operation parameters.

The test signal may be digitally synthesised by the digital processor, or may be provided by an external analogue means.

Preferably, the circuit further comprises a bus to which the digital processor, digital to analogue converter and analogue to digital converter are connected.

The analogue to digital converter may use neuromorphic signal processing.

The processing provided by analogue processors may comprise one or more functions which require a plurality of analogue operations.

Preferably, the plurality of analogue operations are performed in parallel.

Preferably, the results of the plurality of analogue operations are output from the analogue processing means via a single output connection to the analogue to digital converter.

Preferably, the analogue processing means includes transistors biased to operate in the weak inversion region.

Preferably, the analogue processing means is constructed using transistors, resistors, capacitors and inductors.

The processing provided by one of the analogue processors may comprise a linear algorithm.

Alternatively, the processing provided by one of the analogue processors may comprise a nonlinear algorithm.

The processing provided by one of the analogue processors may comprise any of Fourier processing, Viterbi decoding, Hidden Markov processing, IMDC Transformation, Turbo decoding, log domain processing, Independent Component Analysis or Vector Quantisation. Other processing may be provided by the analogue processors.

Preferably, the circuit is an integrated circuit.

Preferably, the digital processor is one of a plurality of digital processors provided on the integrated circuit.

Preferably, the digital processor is operative to tune operating parameters of the analogue processing means when the analogue processing means is configured to process analogue values according to the first function.

BRIEF DESCRIPTION OF THE DRAWINGS

A specific embodiment of the invention will now be described by way of example only with reference to the accompanying figures, in which.

DETAILED DESCRIPTION OF THE INVENTION

Figure 1:
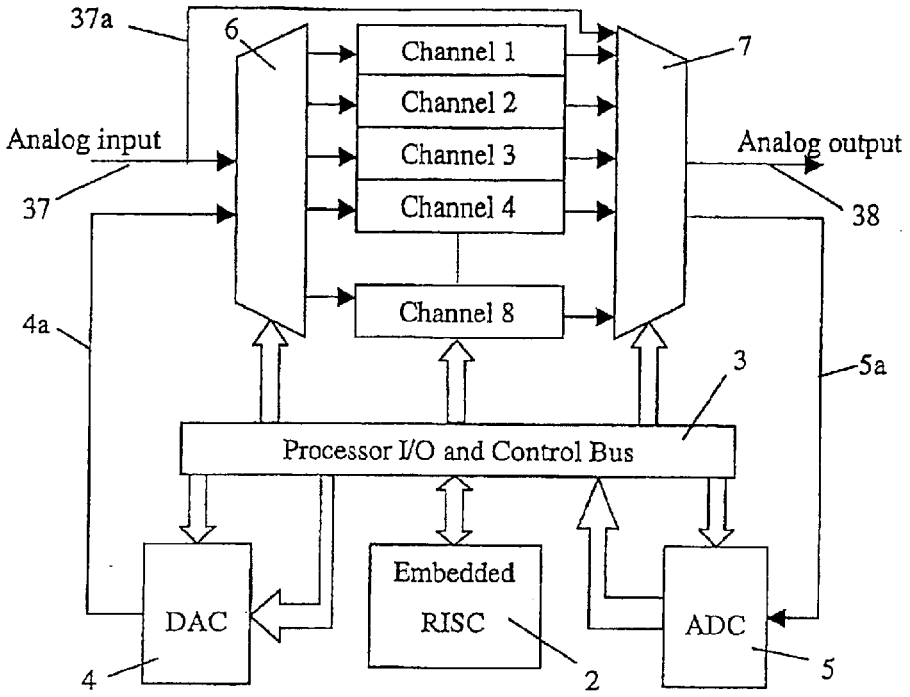
FIG. 1 is a schematic illustration of a circuit according to the invention.

The illustrated embodiment of the invention comprises an integrated digital signal processing system arranged to call analogue subroutines. The integrated circuit shown in FIG. 1 comprises an analogue subroutine block 1, and an embedded reduced instruction set computer (RISC) microprocessor 2. The microprocessor 2 is connected to a processor I/O and control bus 3. Also connected to the bus 3 are a digital to analogue converter 4 (DAC) and an analogue to digital converter 5 (ADC). The DAC has an output which is connected to an analogue signal demultiplexer 6, which in turn is connected to the analogue subroutine block 1. Outputs of the analogue subroutine block 1 are connected to an analogue signal multiplexer 7. An output of the signal multiplexer 7 is connected to the ADC 5.

Operational control signals are passed from the microprocessor 2 to the DAC 4, ADC 5, analogue signal demultiplexer 6 and analogue signal multiplexer 7 via the bus 3.

Figure 2:
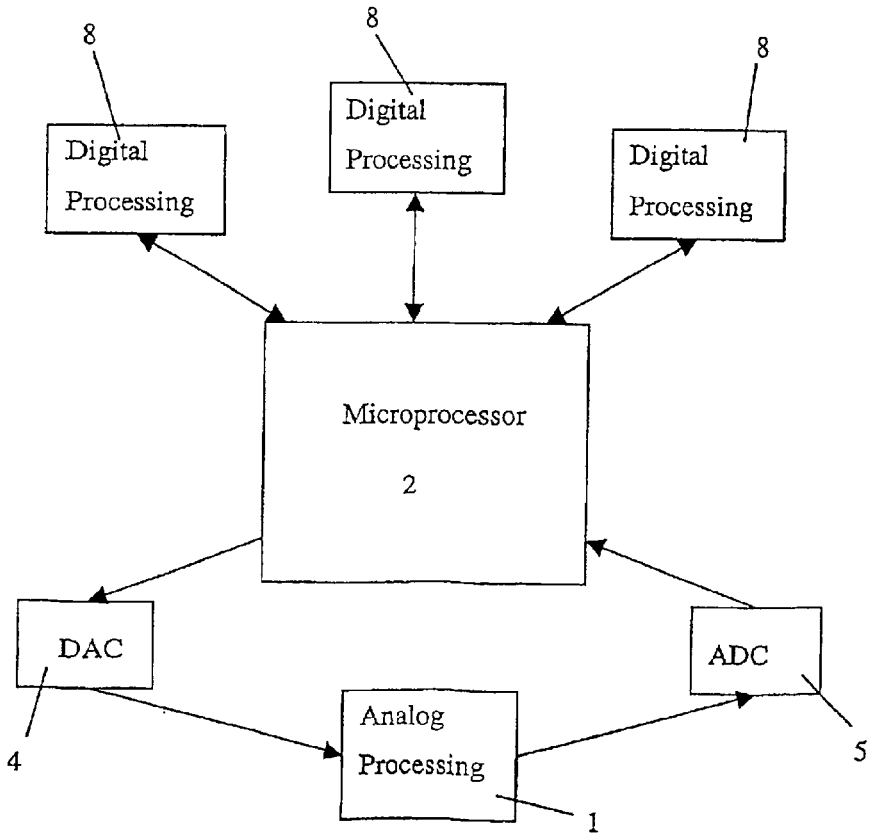
FIG. 2 is a schematic illustration of the circuit of FIG. 1 together with associated digital processors.

In use, the processor executes a digital program in a conventional manner. Referring to FIG. 2, the microprocessor 2 executes the program in a conventional manner by calling different digital signal processors 8. The analogue subroutine block 1 is configured to carry out an operation which would be computationally very expensive if performed by a digital processor, for example a Fourier transform. When the system application requires a Fourier transform to be performed, digital values are passed via the DAC 4 to the analogue subroutine block 1 which performs the Fourier transform. Analogue output values are passed to the ADC 5, and converted digital values are passed to the microprocessor 2. The fact that an analogue block has been used to perform the Fourier transform is not visible to a user of the microprocessor (for example a programmer).

Referring again to FIG. 1, if the input values are initially stored by the microprocessor in digital form, they are passed to the bus 3, and are then converted to an analogue representation by the DAC 4, and are passed to the analogue signal demultiplexer 6. However if input values are initially in analogue form they are passed to the analogue signal demultiplexer 6 from the external input 37. The signal demultiplexer 6 separates the analogue values and passes them to the analogue subroutine block 1 where the Fourier transform is performed (this is described in detail further below).

Analogue values output from the analogue subroutine block are passed to the analogue signal multiplexer 7. If the output values are required in digital form, the analogue signal multiplexer 7 passes the output values to the ADC 5. The ADC 5 converts the analogue output values to digital output values which are passed via the bus 3 to the microprocessor 2. If the analogue output values are required in analogue form, the analogue signal multiplexer 7 passes the output values directly to the external output 38.

The external input 37 includes a branch 37*a* which passes directly to the analogue signal multiplexer 7. This may be used for example when a signal is to be processed initially in the digital domain and then subsequently in the analogue domain (the signal passes to the microprocessor 2 for digital processing, and subsequently is passed to the analogue subroutine block 1). Alternatively, the branch 37*a* may be used when it is desired to compare a signal output by the subroutine block 1 with the signal input to the subroutine block 1.

If inputs and outputs to the Fourier transform are both digital, then from the point of view of the microprocessor 2, the Fourier transform performed by the analogue subroutine block 1 is effectively a sub-routine to which digital values are sent and from which digital values are received.

The analogue subroutine block 1 used to perform the Fourier transform is an eight-channel filter bank, each filter being provided with a power level detector. This combination of filters and power level detectors provides a simple Fourier Processor. The Fourier Processor filters an incoming signal into a range of frequency sub-bands and determines the average power contained within each of those frequency bands, i.e. basically performing spectral analysis. The illustrated example has eight sub-bands with a $4^{th}$ order filter selecting each sub-band.

Figure 3:
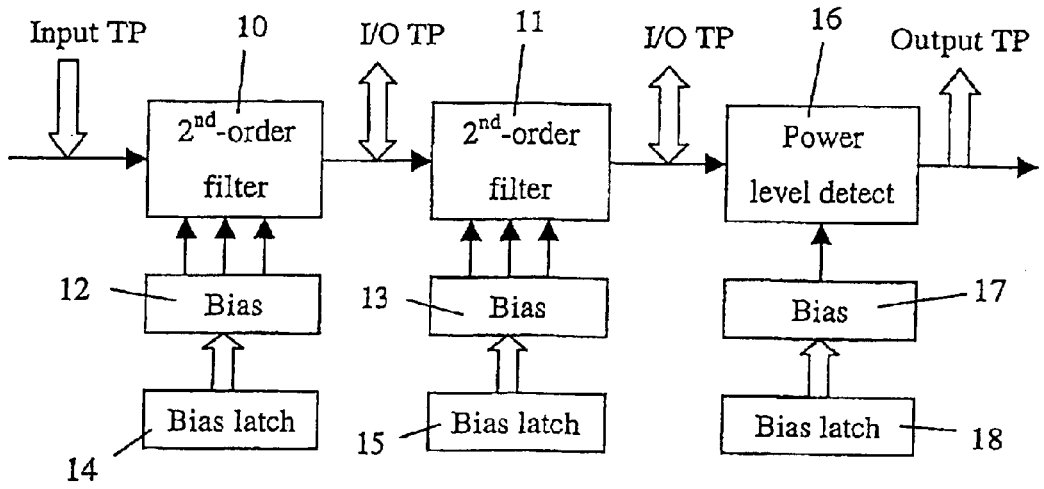
FIG. 3 is a schematic illustration of a single analogue processing means of the circuit shown in FIGS. 1 and 2.

A channel of the filter bank is shown schematically in FIG. 3. Each channel comprises a cascade of two $2^{nd}$ order bandpass sections 10, 11, thus implementing a $4^{th}$ order bandpass characteristic per channel. Each $2^{nd}$ order section 10, 11 has a centre frequency, bandwidth and gain each of which is independently adjustable. The values of the centre frequency, bandwidth and gain are controlled for each section 10, 11 by a bias circuit 12, 13. Each bias circuit 12, 13 consists of a number of switchable current sources which are selected according to digital values set in a bias latch 14, 15. The digital values are digital words, and the length of the words (i.e. the number of bits) depends upon the tuning resolution required. For example, a fairly coarse tuning may require only 3 or 4 bits, while a value that needs to be finely tuned may have an 8-bit word. The size of each bias latch 14, 15 is equal to the sum of the number of bits required for tuning the corresponding section 10, 11. Bach word value set in the bias latch is controlled by the microprocessor 2. The microprocessor 2 can vary all of the word values in the latch at once, or may adjust a single word value if only one particular parameter is being tuned.

It will be appreciated that the bias circuits 12, 13 need not necessarily consist of current sources, but may for example comprise banks of capacitors or other components.

The two $2^{nd}$ order filters 10, 11 within the channel are nominally identical. The centre frequencies of the filters 10, 11 are set to be different from the filters of all other channels. For an audio processing application the filters are designed so that each channel covers a separate sub-band in the range approx. 300 Hz–10 kHz. The exact frequency range, centre frequency and tuning range of each channel is dependent upon the application for which the circuit is intended.

A power level detector 16 determines the average power contained within the particular frequency band of the filter cascade 10, 11. The operation of the power level detector is similar to the received signal strength indicator (RSSI) function used to provide automatic gain control in applications such as wireless receivers. Typically an input signal X is passed through a squaring circuit (to generate $X^2$), and then this squared output is 'averaged' using a lowpass filter. The parameters of the lowpass filter are controlled by a bias circuit 17 and a bias latch 18. If the lowpass filter bandwidth is too high then unwanted higher frequency components may appear in the output of the power level detector 16. If the lowpass filter bandwidth is very low then the response time of the power level detector to variations in the input power is very slow. The optimal bandwidth will vary according to the application of the circuit, and is selected accordingly. The bias circuit 17 and bias latch 18 operate in the same manner as the previously described bias circuits 12, 13 and bias latches 14, 15.

Figure 4:
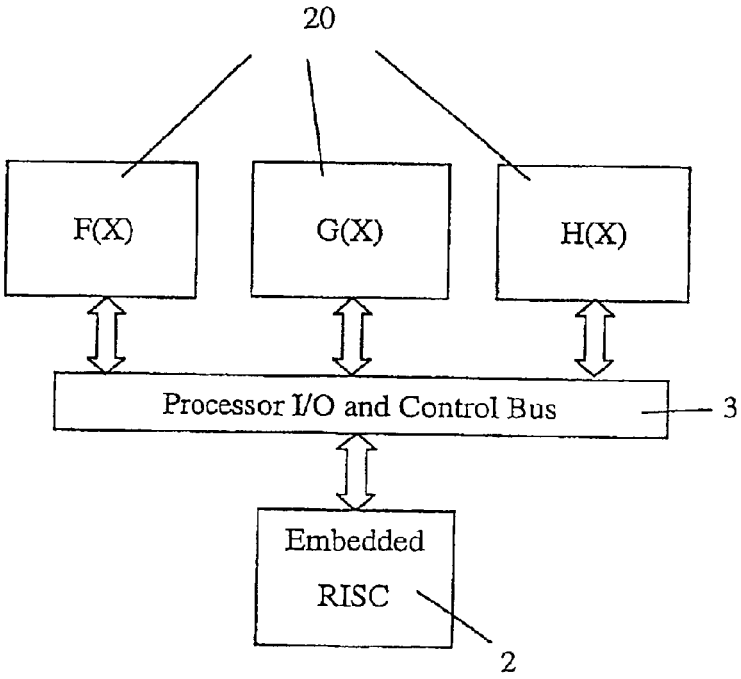
FIG. 4 is a schematic illustration of several analogue processing means arranged according to the invention.

In addition or as an alternative to the Fourier processor shown in FIG. 3, the following functions may be carried out by analogue subroutine blocks: Viterbi Decoder, Hidden Markov, IMDC Transform, Turbo Decoder, log domain filters, Independent Component Analysis, Vector Quantisation, etc. These are analogue implementations of digitally computation intensive and power hungry functions. An example of this is shown in FIG. 4, where three analogue subroutine blocks 20 are connected via the bus 3 to the microprocessor 2. Connections to the analogue subroutine blocks 20 are controlled by the analogue signal demultiplexer shown in FIG. 1.

The analogue signal demultiplexer 6 is basically a switching network that connects the analogue input signal to one or more of the analogue subroutine blocks (any other suitable switch arrangement may be used). The analogue signal demultiplexer 6 is shown schematically in FIG. 5. Electronic switches 31–36 are controlled by the microprocessor (not shown in FIG. 5). The analogue signal demultiplexer 6 is provided with two inputs. A first input 4*a* carries signals from the DAC (not shown in FIG. 5). The second input 37 is an external input to the analogue signal demultiplexer 6. Signals carried by the external input 37 may come from an external test pin, or from an external input such as an off-chip sensor, or from an on-chip sensor, or may be the output of an analogue circuit somewhere else on the chip.

Figure 5:
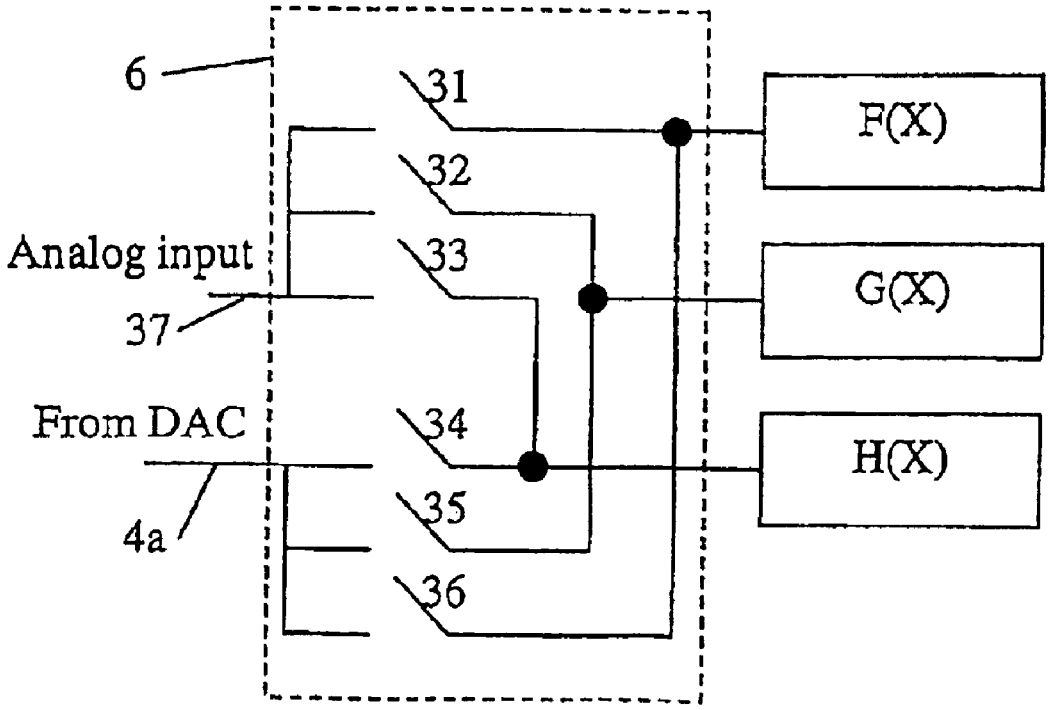
FIG. 5 is a schematic illustration of an analogue signal demultiplexer shown in FIG. 1.

Referring to FIG. 5, if switch 31 is shut then an input signal from an external analogue input 37 is fed to analogue subroutine block F(X). If switch 35 is shut then the digital signal from the microprocessor is passed through the DAC 4 and fed to the analogue subroutine block G(X). The analogue subroutine blocks may process analogue values according to any suitable function, for example analogue subroutine block F(X) may be a filter, and analogue subroutine block G(X) may be a Fourier processor. In some instances the analogue subroutine blocks F(X), G(X) may perform similar functions having different characteristics. For example, F(X) may be a filter having a 6th order Butterworth response, and G(X) may be a filter having an 8th order Cauer response. It is possible to configure a particular analogue subroutine block to perform a first filter function, and then reconfigure the same analogue subroutine block to perform a second filter function, by adjusting operating parameters of the subroutine block.

The analogue signal multiplexer 7 performs the reverse operation to the analogue signal demultiplexer 6. While the analogue signal demultiplexer 6 routes one of two input channels 4*a*, 37 to one or more analogue subroutine block inputs, the analogue signal multiplexer routes one of the analogue subroutine block outputs to one of two output channels. Referring to FIG. 1, a first output channel 5*a* carries signals to the ADC, and a second output channel 38 carries signals to external analogue components. Again, the multiplexer is a simple switching network, with the switch configuration being controlled by the RISC processor. During operation it may be the case that the output signal from the analogue processing section is not passed to the RISC processor but is instead output off-chip (e.g. to an off-chip transducer) or is fed to another on-chip component (such as an integrated transducer). In this case, the output of the appropriate analogue subroutine will be routed by the analogue signal multiplexer to the external output channel 38.

The functionality provided by the analogue subroutine blocks 20 shown in FIG. 4 is reconfigurable. Interconnections between the various analogue subroutine blocks can be made to modify the high level functionality provided by a combination of analogue subroutine blocks. To do this, input-output connections between the various analogue subroutine blocks are made by a switching network known as a crosspoint switch (not shown). The crosspoint switch is controlled by the microprocessor 2. It will be appreciated that any suitable form of switch may be used.

The usefulness of the reconfigurable functionality is illustrated in the following example: in one possible application of the invention, the Fourier Transform subroutine block 1 is required to process an audio signal in order to drive a graphics equaliser display. In another possible application, the Fourier Transform block 1 is the front-end of a simple speech recognition system. In this second application example the microprocessor 2 configures the crosspoint switch so that the output from the Fourier Transform block is connected to further analogue subroutine blocks including a Hidden Markov Model subroutine in order to implement a simple speech recognition system.

The functionality provided by a single analogue subroutine block may be reconfigured. For example, referring to FIG. 1 the analogue subroutine block provides a Fourier transform using fourth order bandpass filters in a set of channels, implemented as a cascade connection of two second-order bandpass sections. In some particular application it may be adequate to have only a second order bandpass filter in each channel of the analogue subroutine block. In this case, the microprocessor 2 configures the crosspoint switch so that one of the second order sections in each channel is disconnected and powered down. This is done to reduce power consumption.

The channels of the analogue subroutine block 1 shown in FIG. 1 are tuned to ensure that the channels are operating correctly. Tuning of the channels is controlled by the microprocessor 2, and follows a pre-programmed software algorithm. The microprocessor 2 sequentially tunes each of the channels, one circuit block at a time, adjusting one or more tuning parameters at once. The microprocessor 2 initially sets the bit pattern in the bias latch to give nominal bias values. An analogue input is then applied, and the microprocessor 2 configures the analogue signal demultiplexer 6 so that the analogue input is routed to which ever analogue subroutine block is being tuned (typically each analogue subroutine block is tuned individually). If the microprocessor 2 is generating the test signal itself, for example a digitally synthesised signal, then the output of the DAC 4 will be routed through to the input of the analogue subroutine block under test. However in some cases the input signal used for tuning may come from an external source, for example a swept frequency voltage source, via an input test pin. In this case, the analogue signal demultiplexer 6 will be set so that the external input signal is routed to the input of the subroutine under test. In this case, the output of the DAC 4 will not be connected to any of the analogue subroutine inputs.

The analogue signal multiplexer 7 is configured by the microprocessor 2 to ensure that the output signal from the subroutine or subroutine channel under test is routed to the microprocessor 2 via the ADC 5. Since the input stimulus and output response are known, the microprocessor 2 is then able to determine the response of the subroutine or subroutine channel under test. This response is compared with a stored template, and if the measured response deviates from the stored template then the bias latch 14, 15 bit pattern is adjusted and the process repeated. The adjustment of the bit pattern stored in the bias latch 14, 15 is carried out in coarse and fine tuning steps, depending on how far apart the measured and required responses are. When the response is measured to be within a required tolerance, the microprocessor 2 moves on to the next subroutine or subroutine channel to be tuned.

The tuning process is carried out at turn-on and then at appropriate intervals thereafter. Tuning may be carried out on the fly. When not required for tuning, the microprocessor 2 may be powered down, or else may be used to run conventional programs if these are required by the system. Similarly, the ADC, the DAC and analogue components may be powered down when they are not in use. Powering down components in this way reduces power consumption.

A second way in which the tuning of the subroutine block 1 may be carried out is by using statistical tuning. In statistical tuning a number of subroutine bias values are varied, and the circuit response is measured and recorded. This process is repeated a number of times. From the measured responses obtained, statistical algorithms are used to quickly tune the circuit into the 'centre' of the design space.

The bias values used for statistical tuning are pre-programmed into the microprocessor 2 memory, and are selected according to the function of the analogue subroutine block 1 and process variations arising from the manner in which the analogue subroutine block 1 was fabricated.

Statistical tuning is advantageous compared to conventional tuning because it is more likely to bring the analogue subroutine block 1 to a location in the centre of the design region of the analogue subroutine block 1. If conventional tuning was to be used the circuit could be tuned until it passed all the required specifications, but it might in fact be right on the edge of the design region. This would mean that if for example the temperature changed slightly, the performance of the analogue subroutine block 1 might drift outside of the design region. If the analogue subroutine block 1 is tuned to be in the centre of the design region, for example using statistical tuning, then a slight change in operating parameters would not cause the analogue subroutine block 1 to move outside of the design region.

Statistical tuning is described in: Informative Experimental Design for Electronic Circuits', by Z. Malik, H, Su, J. Nelder, Quality and Reliability Engineering International, Vol14, pp177–186, 1998; and is also described in: Tolerance Design of Electronic Circuits, R. Spence and R. S. Soin, Addison-Wesley, Reading, 1998. Both of these references refer to the use of statistical methods to optimise a design before fabrication. Statistical tuning is generally not used by the prior art because it had been considered that there were insufficient connections to allow efficient communication between analogue components and a tuning processor The invention allows the statistical tuning approach to be used because it provides large numbers of connections between the microprocessor 2 and the analogue subroutine blocks (they are all part of a single integrated circuit). Communication between the analogue subroutine block 1 and the microprocessor 2 via the bus 3 are very fast as no off-chip communication is involved, allowing statistical tuning to be carried out quickly.

The microprocessor 2 is implemented using a conventional user-configurable RISC architecture. Functionality is given to the architecture by a compact software algorithm. The software algorithm consists of maintenance code for the one or more analogue subroutine blocks, and control code for the DAC, ADC, analogue signal demultiplexer and multiplexer. The maintenance code is invoked periodically to re-calibrate parameters of the analogue subroutine blocks, which might have drifted from their optimal values. The control code handles the addressing of the analogue components (subroutines, ADC etc) and the important task of synchronisation of the analog/digital computations.

The software algorithm is embedded on the chip and serves as a kernel for other applications programs. The algorithm shields programmers using the chip from having to know whether their code is being implemented in digital or analog. This is an important feature of the circuit, and in particular of the use of analogue subroutines.

The microprocessor includes the necessary memory, bus arbiter, address decoders and other peripheral circuits required for the operation of a microprocessor subsystem.

A Fourier processor having a sixteen-channel filter with a second-order filter may be used in place of the Fourier processor shown in FIGS. 1 and 3. A processor of this type has previously been implemented as part of a cochlear implant (UK Patent No 0111267.1, 'Cochlear Implant', UK Filing date 05 May 01).

Examples of functions that may be performed by analogue subroutine blocks are considered in more detail below:

Hidden Markov Model State Decoding: Hidden Markov models (HMMs) are models used to characterise the properties of a signal based on the statistical properties of that signal, i.e. using a stochastic approach. HMMs are widely used in speech recognition systems. An HMM speech recognition system consists of a probabilistic state machine and a method for tracing the state transitions of the machine for a given input speech waveform. An analogue implementation of HMM decoding is described in 'A Micropower Analogue Circuit Implementation of Hidden Markov Model State Decoding', J. Lazzaro, J. Wawrzynek, R. P. Lippman, IEEE Journal of Solid-State Circuits, Vol.32, No. 8, August 1997, pp1200–1209.

Viterbi decoding: Viterbi decoders implement the Viterbi algorithm for the error correction of convolutional codes, and are widely used in modem digital communication systems. References relating to analogue Viterbi decoders include: 'BiCMOS Circuits for Analogue Viterbi Decoders', M. H. Shakiba, D. A. Johns, K. W. Martiv, IEEE Trans. on Circuits and Systems-II, Vol.45, No.12, December 1998, pp. 1527–1537.

'Decoding in Analogue VLSI', H-A Loeliger, F. Tarkoy, F. Lustenberger, M. Helfenstein, IEEE Communications Magazine, April 1999, pp.99–101. 'Performance of Analogue Viterbi Decoding', K. He, G. Cauwenberghs, 42$^{nd}$ Midwest Symposium on Circuits and Systems, 2000, Volume: 1, 2000, pp. 2–5.

Independent Component Analysis: An independent component analyser (ICA) is an adaptive network architecture for the separation of independent sources based upon the H-J network proposed by Herault and Jutten. An analogue implementation of ICA is described in 'Analogue CMOS Integration and Experimentation with an Autoadaptive Independent Component Analyzer', M. Cohen, A. Andreou, IEEE Trans. on Circuits and Systems-II, Vol. 42, No.2, February 1995, pp.65–77.

Vector Quantisation: Vector Quantisation (VQ) is a common technique for the efficient digital coding of analogue data, with applications to pattern recognition and data compression in vision, speech etc. An analogue implementation is described in 'A Low-Power CMOS Analogue Vector Quantizer', G. Cauwenberghs and V. Pedroni, IEEE Journal of Solid-State Circuits, Vol.32, No.8, August 1997, pp.1278–1283.

The DAC 4 and ADC 5 can be implemented using a number of different approaches. A popular way of implementing an integrated DAC is to use a current-steering architecture (e.g. 'An 80-MHz 8-bit CMOS D/A Converter', T. Miki et. al, IEEE Journal of Solid-State Circuits, Vol.SC-21, No.6, December 1986, pp.983–988).

The ADC may be implemented in a number of ways depending on the system requirements. If very high accuracy (number of bits) were required then a sigma-delta converter would be a useful approach. If high accuracy is not required, but power consumption and chip area are to be minimised, a Successive Approximation Conversion ADC or similar may be used.

A recently-proposed approach to analogue to digital conversion uses neuromorphic signal processing, via two integrate-and-fire spiking neurons, ('A Current-Mode Spike-Based Overrange-Subrange Analog-to-Digital Converter', R. Sarpeshkar, R. Herrera, H. Yang, Proc. IEEE Int. Symp. on Circuits and Systems (ISCAS) 2000, May 28–31 2000, Geneva, Switzerland, Vol.IV pp.397–400). This type of converter is suited for compact, low-power applications, and may be used to implement the ADC 5 used by the invention. Data is encoded as 'spikes' whereby the interspike intervals are analogue while the spike number itself is discrete. Spikes are thus naturally suited for hybrid computation i.e. computation which is a mixture of analogue and digital. This 'spike-based' approach is also known as pulse-frequency modulation (PFM) (see e.g. 'A Communication Scheme for Analogue VLSI Perceptive Systems', A. Mortara, E. Vittoz, P. Vernier', IEEE Journal of Solid-State Circuits, Vol.30, No.6, June 1995, pp.660–669). PFM signals have been shown to be a very efficient means of communication between analogue subsystems and between analogue and digital subsystems, particularly if the analogue subsystem has a large number of parallel outputs. Thus the invention may advantageously use PFM coding schemes for the transmission of data between analogue subroutine blocks and also to external components.

The analogue components used to implement the functions may be transistors biased in the weak inversion region. The transistors may be CMOS transistors. Alternatively or additionally bipolar transistors or strongly inverted CMOS transistors may be used.

Where the analogue subroutine block is implemented in ultra-low power CMOS technology, the power savings provided by the circuit are substantial, and in some cases may be orders of magnitude better than the available digital signal processing implementations of the function provided by the analogue subroutine block 1 (or other functions implemented by other analogue subroutine blocks).

Although the illustrated embodiment comprises a RISC microprocessor, it will be appreciated that a CISC microprocessor may be used. Alternatively, some other form of microprocessor may be used. The term microprocessor is intended to mean a processor capable of running an instruction set. The term microprocessor is not intended to imply that the processor includes all of the functionality of a conventional microprocessor. For example, the microprocessor may be a microprocessor core. Several microprocessors may be provided on a single chip.

The circuit may be used to process sampled data signals.

The analogue subroutine blocks may be implemented using optical components. For example, a Fourier Transform subroutine block could be implemented using known arrangements of optical sources and detectors positioned in appropriate focal planes.

What is claimed is:

1. A circuit comprising a digital processor, analogue processing means, a digital to analogue converter for converting digital values output from the digital processor into analogue values which are processed by the analogue processing means, and an analogue to digital converter for converting resulting analogue values into digital values for input to the digital processor, wherein the analogue processing means comprises one or more analogue processors, and the circuit is dynamically reconfigurable under the control of the digital processor, such that analogue values are processed according to a first function by the analogue processing means, and following reconfiguration, analogue values are processed according to a second function by the analogue processing means.

2. A circuit according to claim 1, wherein the digital processor is operative to tune operating parameters of the analogue processing means once the analogue processing means has been reconfigured to process analogue values according to the second function.

3. A circuit according to claim 1, wherein the analogue processing means comprises a plurality of analogue processors arranged to process analogue values according to different functions, a first analogue processor being arranged to process analogue values according to the first function and a second analogue processor being arranged to process analogue values according to the second function, the digital processor being operative to select the analogue processors.

4. A circuit according to claim 1, wherein a given analogue processor is configured to process analogue values according to the first function, and has adjustable operating parameters such that the same analogue processor may be reconfigured to process analogue values according to the second function, by adjusting the operating parameters, the digital processor being operative to select the operating parameters.

5. A circuit according to claim 1, wherein the circuit is a digital signal processing system, and the first and second functions are computational functions.

6. A circuit according to claim 1, wherein the digital processor is a microprocessor.

7. A circuit according to claim 1, wherein the digital processor is constructed from dedicated logic.

8. A circuit according to claim 1, wherein the circuit further comprises an analogue signal demultiplexer arranged to select an analogue processor required by the digital processor, the analogue signal demultiplexer being connected between the digital to analogue converter and the analogue processor.

9. A circuit according to claim 8, wherein the analogue signal demultiplexer includes an input from an analogue processor.

10. A circuit according to claim 1, wherein the digital processor is operative to select more than one analogue processor in combination in order to provide a combined function.

11. A circuit according to claim 10, wherein the circuit further comprises a switch arranged to select the combination of the analogue processors.

12. A circuit according to claim 11, wherein the switch is a cross-point switch.

13. A circuit according to claim 1, wherein at least one of the analogue processors comprises a plurality of processing channels, and the circuit further comprises a switch arranged to select a required number of channels to provide a function with a required accuracy or speed.

14. A circuit according to claim 13, wherein the switch is a cross-point switch.

15. A circuit according to claim 1, wherein the circuit further comprises an analogue signal multiplexer connected between the analogue processing means and the analogue to digital converter.

16. A circuit according to claim 15, wherein the analogue signal multiplexer is provided with an output which passes to an analogue system other than the analogue to digital converter.

17. A circuit according to claim 15, wherein the analogue signal multiplexer is provided with an input from an analogue source.

18. A circuit according to claim 1, wherein the circuit further comprises bias current generation means arranged to provide bias currents which determine operating parameters of the one or more analogue processors.

19. A circuit according to claim 18, wherein the circuit further comprises bias latches connected to the bias current generation means, the bias latches being arranged to hold digital values which determine the bias currents provided by the bias current generation means.

20. A circuit according to claim 19, wherein the digital values held by the bias latches are provided by the digital processor.

21. A circuit according to claim 1, wherein the digital processor is arranged to tune operating parameters of one or more analogue processors by adjusting the operating parameters individually, applying a test signal to the one or more analogue processors, monitoring the output of the one or more analogue processors, and iterating until the operation of one or more analogue processors is determined to be satisfactory.

22. A circuit according to claim 1, wherein the digital processor is arranged to tune operating parameters of one or more analogue processors by repeatedly adjusting a plurality of operating parameters of the one or more analogue processors in combination and monitoring the response to a test signal of the one or more analogue processors, in order to obtain statistical information relating to operation of the one or more analogue processors, and then selecting an optimal set of operation parameters.

23. A circuit according to claim 21, wherein the test signal is digitally synthesised by the digital processor.

24. A circuit according to claim 21, wherein the test signal is provided by an external analogue means.

25. A circuit according to claim 1, wherein the circuit further comprises a bus to which the digital processor, digital to analogue converter and analogue to digital converter are connected.

26. A circuit according to claim 1, wherein the analogue to digital converter uses neuromorphic signal processing.

27. A circuit according to claim 1, wherein the processing provided by analogue processors comprises one or more functions which require a plurality of analogue operations.

28. A circuit according to claim 27, wherein the plurality of analogue operations are performed in parallel.

29. A circuit according to claim 28, wherein the results of the plurality of analogue operations are output from the analogue processing means via a single output connection to the analogue to digital converter.

30. A circuit according to claim 1, wherein the analogue processing means includes transistors biased to operate in the weak inversion region.

31. A circuit according to claim 1, wherein the analogue processing means is constructed using transistors, resistors, capacitors and inductors.

32. A circuit according to claim 1, wherein the processing provided by one of the analogue processors comprises a linear algorithm.

33. A circuit according to claim 1, wherein the processing provided by one of the analogue processors comprises a nonlinear algorithm.

34. A circuit according to claim 1, wherein the processing provided by one of the analogue processors comprises any of Fourier processing, Viterbi decoding, Hidden Markov processing, IMDC Transformation, Turbo decoding, log domain processing, Independent Component Analysis or Vector Quantisation.

35. A circuit according to claim 1, wherein the circuit is an integrated circuit.

36. A circuit according to claim 35, wherein the digital processor is one of a plurality of digital processors provided on the integrated circuit.

37. A circuit according to claim 1, wherein the digital processor is operative to tune operating parameters of the analogue processing means when the analogue processing means is configured to process analogue values according to the first function.

* * * * *